US009978239B2

(12) United States Patent
Song et al.

(10) Patent No.: US 9,978,239 B2
(45) Date of Patent: May 22, 2018

(54) ELECTRIC SHOCK WARNING DISTRIBUTION BOARD SYSTEM INCLUDING WEARABLE DEVICE FOR WARNING ELECTRIC SHOCK AND DISTRIBUTION BOARD LINKED THERETO

(71) Applicant: SN CO., LTD., Daejeon (KR)

(72) Inventors: Soo Joon Song, Daejeon (KR); Su Gang Chae, Daejeon (KR)

(73) Assignee: SN CO., LTD., Daejeon (KR)

( * ) Notice: Subject to any disclaimer, the term of this patent is extended or adjusted under 35 U.S.C. 154(b) by 0 days. days.

(21) Appl. No.: 15/309,700

(22) PCT Filed: Jan. 26, 2016

(86) PCT No.: PCT/KR2016/000809
§ 371 (c)(1),
(2) Date: Nov. 8, 2016

(87) PCT Pub. No.: WO2016/122184
PCT Pub. Date: Aug. 4, 2016

(65) Prior Publication Data

US 2017/0263097 A1 Sep. 14, 2017

(30) Foreign Application Priority Data

Jan. 30, 2015 (KR) ..... 10-2015-0014828

(51) Int. Cl.
*G08B 21/02* (2006.01)
*G08B 7/00* (2006.01)

(52) U.S. Cl.
CPC ..... *G08B 21/02* (2013.01); *G08B 7/00* (2013.01)

(58) Field of Classification Search
CPC ..... G08B 21/02
(Continued)

(56) References Cited

U.S. PATENT DOCUMENTS 5,623,255 A * 4/1997 Yang ..... A61N 1/14 340/649
6,897,783 B2 * 5/2005 Zeng ..... H02H 5/12 340/539.1

(Continued)

FOREIGN PATENT DOCUMENTS

KR 10-0366765 B1 1/2003
KR 10-2010-0127422 A 12/2010

(Continued)

OTHER PUBLICATIONS

International Search Report for PCT/KR2016/000809 dated Apr. 28, 2016 from Korean Intellectual Property Office.

*Primary Examiner* — Qutbuddin Ghulamali
(74) *Attorney, Agent, or Firm* — Paratus Law Group, PLLC

(57) ABSTRACT

The present invention relates to an electric shock warning distribution system. The electric shock warning distribution system of the present invention may include: a distribution board; and a wearable device configured to monitor bioelectric currents flowing through the body of an operator that operates the distribution board, classify degrees of hazard of the operator according to values of the monitored bioelectric currents, and to warn the operator of levels of electric shock hazard situations according to the classified degrees of hazard, wherein the wearable device is worn by each operator, each wearable device transmits, to other wearable devices located nearby, a warning message that warns other operators of an electric shock hazard situation when the operator is in the hazard situation, and the distribution board receives information on an electric shock hazard situation from each wearable device to warn the hazard situation of the operator.

5 Claims, 4 Drawing Sheets

(58) Field of Classification Search
USPC ..... 340/657
See application file for complete search history.

(56) References Cited

U.S. PATENT DOCUMENTS

| | | | | |
|---|---|---|---|---|
| 9,679,460 | B2 * | 6/2017 | Yamanishi | G08B 21/02 |
| 2015/0170498 | A1 * | 6/2015 | Beggs | B60Q 1/2673<br>340/686.6 |

FOREIGN PATENT DOCUMENTS

| | | | |
|---|---|---|---|
| KR | 10-1194708 | B1 | 10/2012 |
| KR | 10-2015-0006206 | A | 1/2015 |
| KR | 10-1483925 | B1 | 1/2015 |

* cited by examiner

ELECTRIC SHOCK WARNING DISTRIBUTION BOARD SYSTEM INCLUDING WEARABLE DEVICE FOR WARNING ELECTRIC SHOCK AND DISTRIBUTION BOARD LINKED THERETO

CROSS REFERENCE TO PRIOR APPLICATIONS

This application is a National Stage Patent Application of PCT International Patent Application No. PCT/KR2016/000809 (filed on Jan. 26, 2016) under 35 U.S.C. § 371, which claims priority to Korean Patent Application No. 10-2015-0014828 (filed on Jan. 30, 2015), which are all hereby incorporated by reference in their entirety.

TECHNICAL FIELD

The following description relates to an electric shock warning distribution board system including a wearable device and a distribution board linked thereto, in which the wearable device monitors bioelectric currents of an operator that operates the distribution board, and warns the operator of electric shock.

BACKGROUND ART

Generally, in electric rooms of buildings, factories, apartment complexes, or the like, distribution boards are installed to receive high-voltage or extra high-voltage electricity and to distribute electricity to each customer load. The distribution board is divided into an extra high-voltage panel, a transformer panel, and a low-voltage panel according to a current carrying path and voltage of a power system; and the extra high-voltage panel is generally composed of a high-tension power board (LBS), a voltage current transformer for metering (MOF), a voltage transformer for metering (PT), a circuit breaker (VCB), and the like.

The distribution board includes various types of electrical equipment, such as Load Break Switch (LBS), Lightening Arrester (LA), Power Fuse (PF), Metering Out Fit (MOF), Vacuum Circuit Breaker (VCB), and the like; and a bus bar electrically connected with the electrical equipment to input and output electricity supplied from an external source, in which a high-voltage current flows between the electric equipment and the bus bar.

In the case where there is a problem with the distribution board, in order to check or repair the bus bar and each piece of electrical equipment, an operator opens the door of the distribution board, and performs the repair work at a position close to each piece of electric equipment or the bus bar. During such repair work, accidents frequently occur in which the operator gets high-voltage electric shock because of carelessness.

In order to prevent such electric shock accidents, an operator, before checking and repairing the distribution board, is required to completely block electricity supplied to the distribution board by opening various load breakers of the distribution board; to perform voltage detection to check whether a bus bar or electrical equipment is in live state and whether there is a charged electric charge; and to perform a discharging operation to completely discharge charged electric charge. By doing these power cut-off operations, which are a series of safe work practices, electric shock may be prevented even if the operator comes into contact with a bus bar or electrical equipment to check or repair the distribution board.

Upon completing the power cut-off operations, the operator further performs short-circuiting and grounding in the distribution board, performs an operation to prevent input of a circuit breaker (indicating supply of electricity), and then checks and repairs the distribution board. Upon completing the checking and repairing operation, power is provided to electric equipment in reverse order to the aforementioned order of operations, so that the distribution board may operate.

During the power cut-off operations, when a circuit breaker is cut off or a discharging operation is performed, there may be a case where a large arc is generated due to a live wire, indicating a state where electricity flows to electrical equipment, and the charged electric charge. For this reason, in order to prevent electric shock, an operation to prevent input of a circuit breaker or a discharging operation should be performed with a sufficient safety distance from a bus bar or electrical equipment.

However, since blackout accidents caused by the failure in the distribution board have significant effects and results in serious problems, an operator may impatiently hurry to fast check and repair the failure, and may ignore safety regulations, without performing power cut-off operations, to immediately check the distribution board, which leads to frequent electric shock accidents.

In order to prevent such electric shock accidents, there are general methods including: giving a warning to an operator when the operator violates regulations of the power cut-off operations or when the operator approaches too close to electrical equipment or a bus bar without performing safety procedures; cutting off a circuit breaker (which indicates shutting off electricity); or further providing an auxiliary door at a position corresponding to an inner portion of the door of a distribution board to prevent access to electrical equipment or a bus bar.

However, the general methods have a drawback in that the methods, which are merely about calling an operator's attention, may not protect the operator by forcibly preventing the operator from ignoring safety regulations and from performing operations carelessly.

Further, in the case where an operator works in a large distribution board, the general methods have no function to check the operator, such that there may be a case where other operators, without knowing that the operator is working in the distribution board, may input a circuit breaker for normal operation of the distribution board, which may lead to electric shock accidents.

RELATED ART DOCUMENT

Patent Document (Patent Document 1) Korean Utility Model No. 20-0884041

DISCLOSURE

Technical Problem

An object of the present invention is to provide an electric shock warning distribution board system including a wearable device and a distribution board linked thereto, in which the wearable device monitors bioelectric currents of an operator, and warns of a hazard by transmitting levels of hazard situations according to ranges of bioelectric current values, to the wearable device of the operator, nearby wearable devices linked thereto, and the distribution board, so that a dangerous situation of the operator may be handled.

Technical Solution

In order to achieve the above object, the present invention provides a wearable device for warning an electric shock, the wearable device including: a sensor which comes into contact with the body of an operator who operates a distribution board, and is configured to sense bioelectric currents of the operator; and a control unit configured to monitor the sensed bioelectric currents, classify degrees of hazard of the operator according to values of the monitored bioelectric currents, and to warn of the operator of levels of electric shock hazard situations according to the classified degrees of hazard.

The wearable device may further include a warning unit configured to visually and audibly display the levels of electric shock hazard situations.

In response to the sensed bioelectric currents being 7-8 mA or lower, the control unit may output a warning sound and a warning message through the warning unit.

Further, in response to the sensed bioelectric currents being 7-8 mA to 10-15 mA, the control unit may transmit a warning message, notifying the electric shock hazard situation, to nearby wearable devices linked to the wearable device of the operator and the distribution board, so as to notify a hazard situation of the operator.

In addition, in response to the sensed bioelectric currents being 10-15 mA or higher, the control unit may transmit a cut-off instruction to the distribution board to cut off the distribution board, and may notify the cut-off of the distribution board to the nearby wearable devices linked to the wearable device of the operator.

According to a preferred exemplary embodiment of the present invention, an electric shock warning distribution system includes: a distribution board; and a wearable device configured to monitor bioelectric currents flowing through the body of an operator that operates the distribution board, classify degrees of hazard of the operator according to values of the monitored bioelectric currents, and to warn the operator of levels of electric shock hazard situations according to the classified degrees of hazard, wherein the wearable device is worn by each operator, each wearable device transmits, to other wearable devices located nearby, a warning message that warns other operators of an electric shock hazard situation when the operator is in the hazard situation, and the distribution board receives information on an electric shock hazard situation from each wearable device to warn the hazard situation of the operator.

In response to the bioelectric currents being 7-8 mA or lower, the wearable device may output itself a warning sound and a warning message.

In response to the bioelectric currents being 7-8 mA to 10-15 mA, the wearable device may transmit a warning message that notifies the electric shock hazard situation, to the other nearby wearable devices and the distribution board, so as to notify the hazard situation of the operator.

In response to the bioelectric currents being 10-15 mA or higher, the wearable device may transmit a cut-off instruction to the distribution board to cut off the distribution board, and may notify the cut-off of the distribution board to the nearby wearable devices.

Further, the distribution board may further include: a warning unit configured to output the warning message received from the wearable device; and an electric shock breaker configured to cut off power supplied from a main breaker or some of sub breakers in response to receiving the cut-off instruction from the wearable device.

Advantageous Effects

As described above, according to the present invention, the wearable device for warning an electric shock may monitor bioelectric currents of an operator and warns the operator of levels of hazard situations according to the monitored bioelectric currents.

Further, wearable devices worn by an operator and nearby coworkers may be linked to each other to share information on a dangerous situation. Accordingly, in the case where an operator may not escape from electric shock by himself due to low-voltage electric shock, nearby coworkers may be notified of the situation and may help the operator to escape from the dangerous situation.

In addition, in the case where the monitored bioelectric currents of an operator are in a third range, which is the highest level of hazard, a main breaker or a sub breaker may be automatically shut off by using an electric shock breaker of a distribution board, thereby protecting the operator.

BEST MODE

Figure 1:
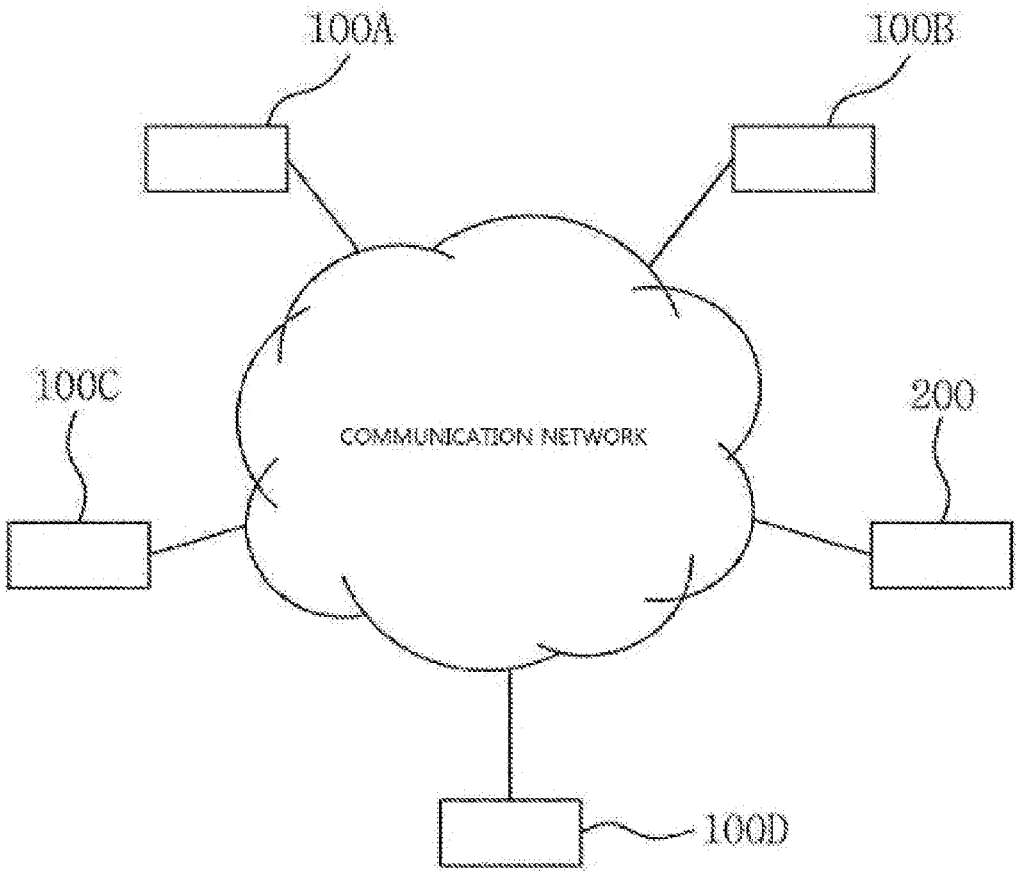
FIG. 1 is a diagram explaining an electric shock warning distribution board system according to an exemplary embodiment of the present invention.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the ideas and scope of the present invention.

Like reference numerals generally denote like elements in the description of each drawing. In the following description, a detailed description of known functions and configurations incorporated herein will be omitted when it may obscure the subject matter of the present invention.

Terms such as "first" and "second" can be used in describing various elements, but the above elements shall not be restricted to the above terms. The above terms are used only to distinguish one element from the other.

For instance, the first element can be named the second element, and vice versa, without departing the scope of claims of the present invention.

The term "and/or" shall include the combination of a plurality of listed items or any of the plurality of listed items.

When one element is described as being "connected" or "accessed" to another element, it shall be construed as being connected or accessed to the other element directly but also as possibly having another element in between.

On the other hand, if one element is described as being "directly connected" or "directly accessed" to another element, it shall be construed that there is no other element in between.

The terms used in the description are intended to describe certain embodiments only, and shall by no means restrict the present invention.

Unless clearly used otherwise, expressions in a singular form include a meaning of a plural form. In the present description, an expression such as "comprising" "including" is intended to designate a characteristic, a number, a step, an operation, an element, a part or combinations thereof, and shall not be construed to preclude any presence or possibility of one or more other characteristics, numbers, steps, operations, elements, parts or combinations thereof.

Unless otherwise defined, all terms, including technical terms and scientific terms, used herein have the same meaning as how they are generally understood by those of ordinary skill in the art to which the invention pertains.

Any term that is defined in a generally-used dictionary shall be construed to have the same meaning in the context of the relevant art, and, unless otherwise defined explicitly, shall not be interpreted to have an idealistic or excessively formalistic meaning.

Hereinafter, an electric shock warning distribution board system, including a wearable device for warning an electric shock and a distribution board linked thereto according to an exemplary embodiment of the present invention, will be described with reference to FIGS. 1 to 4. In the following description, known matters will be omitted or briefly described in order to clarify the gist of the present invention.

FIG. 1 is a diagram explaining an electric shock warning distribution board system according to an exemplary embodiment of the present invention. Referring to FIG. 1, in the case where a dangerous situation occurs to an operator, the electric shock warning distribution board system transmits, through a communication network, information on the dangerous situation to wearable devices 100A to 100D of an operator, nearby wearable devices linked thereto 100A to 100D, and a distribution board 200, so that nearly coworkers may be notified of the situation and may handle the dangerous situation.

Further, automatic cut-off by using an electric shock breaker of the distribution board 200 may prevent damage in advance. Here, the communication network may be any wireless communication network, such as Wi-Fi, near-field communication, broadcasting, and the like.

Figure 2:
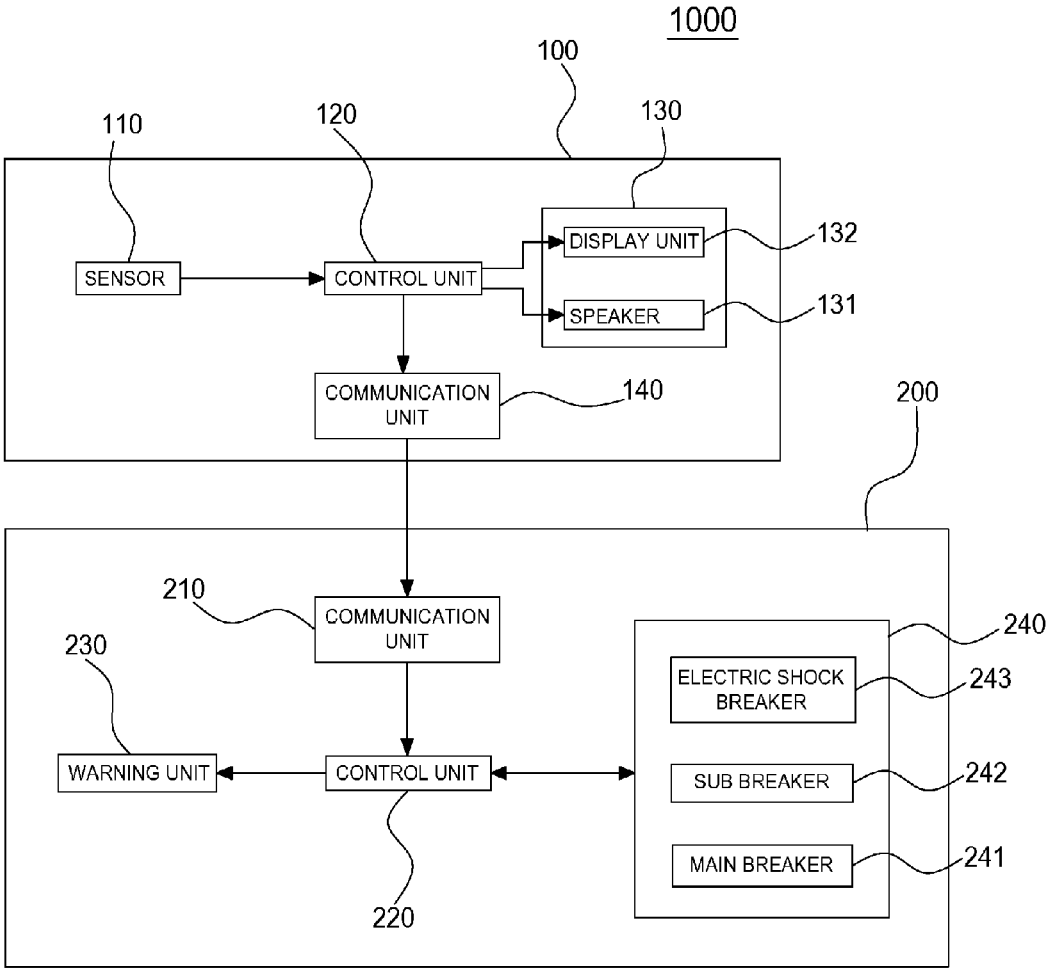
FIG. 2 is a block diagram illustrating an electric shock warning distribution board system according to an exemplary embodiment of the present invention.
Figure 3:
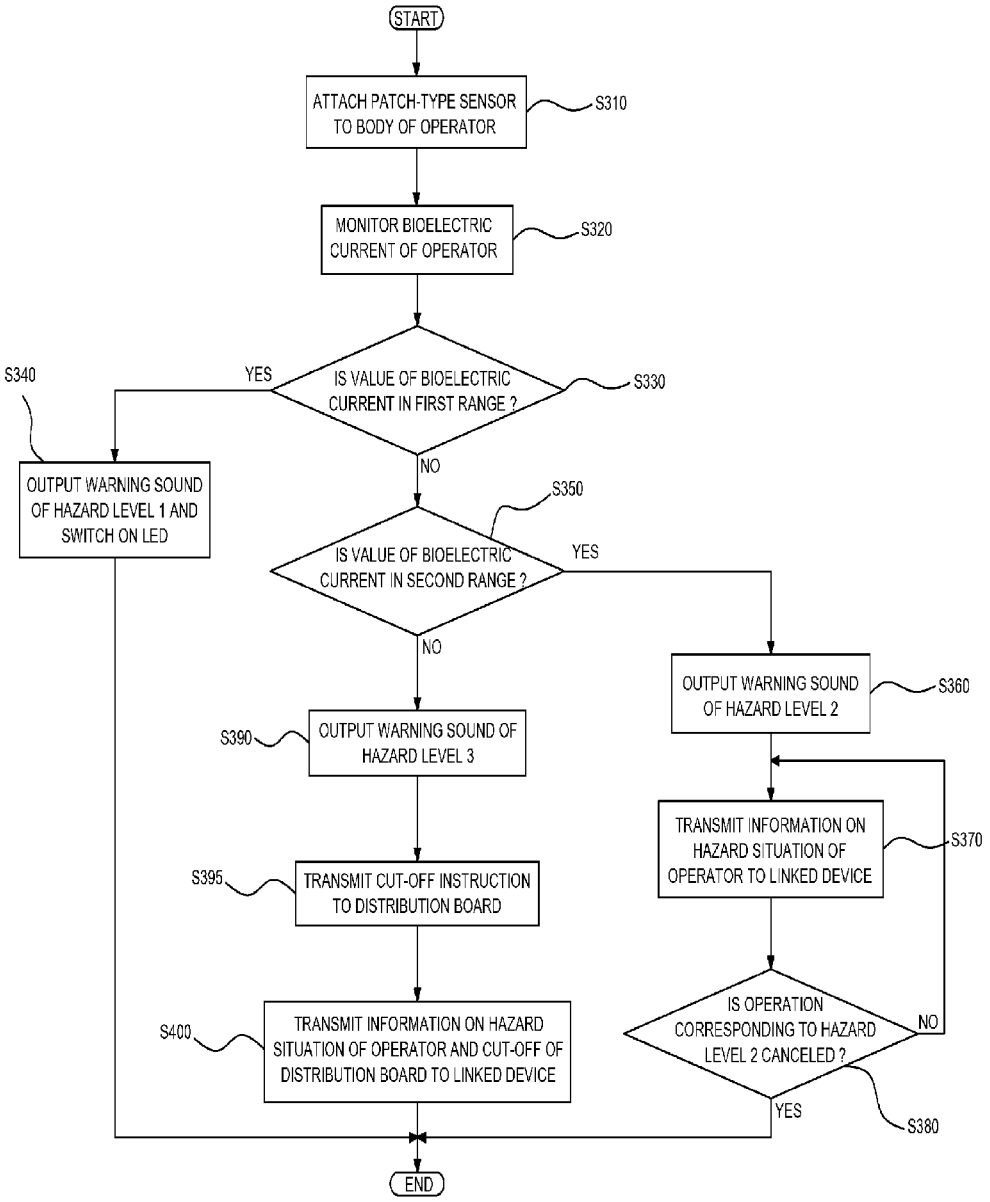
FIG. 3 is a flowchart illustrating a method of warning a wearable device (operator) of an electric shock according to an exemplary embodiment of the present invention.

The wearable devices 100A to 100D and the distribution board 200 will be described in detail with reference to FIG. 2. FIG. 2 is a block diagram illustrating an electric shock warning distribution board system according to an exemplary embodiment of the present invention. The description may also be provided by reference to FIG. 3. FIG. 3 is a flowchart illustrating a method of warning a wearable device (operator) of an electric shock according to an exemplary embodiment of the present invention.

The electric shock warning distribution board system 1000 includes a wearable device 100 and a distribution board 200, and each of the wearable devices 100A to 100D of FIG. 1 may be configured in the same manner as the wearable device 100 of FIG. 2.

The wearable device 100 includes a sensor 100, a control unit 120, a warning unit 130, a communication unit 150, and a setting unit 150. The wearable device 100 may be worn to the body of an operator, and may have a shape of a ring, a bracelet, a patch-type band that is attachable to the human body, and the like. The wearable device 100 may be an electric shock warning device that is attached to the body of an operator to sense bioelectric currents (electric current flowing in the operator's body) and warn the operator of a dangerous situation.

The sensor 110 may be a sensor that senses bioelectric currents (electric current flowing in the operator's body) of an operator wearing the wearable device 100. In this case, the sensor 110 may be formed in a shape that may come into contact with the operator's body. That is, the sensor 110 may be provided at an inner portion of a ring, a bracelet, a patch-type band, and the like, to come into contact with the body in S310.

The control unit 120 monitors, in S320, bioelectric currents sensed by the sensor 110, classifies degrees of hazard of an operator according to values of the monitored bioelectric currents, and warns the operator of levels of hazard situations according to the classified degrees of hazard. Further, upon receiving a warning message, a control signal, and the like from other wearable devices, the control unit 120 determines the degrees of hazard and warns of a hazard situation.

The warning unit 130 includes: a speaker 131 which outputs a warning sound (output when a dangerous situation occurs to an operator wearing a wearable device) and a notification sound (output when a warning message, indicating a dangerous situation of other operator (coworker), is received from other wearable device linked to the wearable device of the operator); and a display unit 132 which visually displays warning. The display unit 132 may be an LED that may be switched on and off in various colors, a display unit that may show texts, pictures, and the like. In this case, the LED may be switched on and off at shorter intervals in case of higher levels of hazard situations.

Under the control of the control unit 120, the warning unit 131 may output a warning sound, a notification sound, a warning message, and the like, which are classified into the levels of hazard situations. With higher levels of hazard situations, the warning sound may be output at shorter intervals, and a sound pitch (frequency) may be higher. Further, the warning sound and the notification sound may be set to have different tones so that the warning sound and the notification sound may be differentiated from each other. In addition, the warning message may include messages indicating the levels of hazard and location information of an operator in a dangerous situation.

The communication unit 140 may transmit and receive a warning message and a control signal, regarding a dangerous situation, to and from other wearable devices 100A and 100D and the distribution board 200 through the communication network of FIG. 1.

In the exemplary embodiment, the levels of hazard may be classified according to bioelectric current values as follows. Here, a threshold of perception current refers to a minimum value of electric current that a person can perceive, which is set at 2 mA or lower. Further, a pain tolerance current refers to a value of electric current that a person can tolerate painful shock when electric current flows through the body, which is set at 7-8 mA. In addition, a let-go current refers to a value of electric current through the body of a person at which they can release by themselves, and which is set at 10 to 15 mA or higher.

Reference current values of the threshold of perception current, pain tolerance current, and let-go current may be changed by an engineer, a user, and the like.

<Hazard Level 1: Bioelectric Currents (First Range) in a Range of Pain Tolerance Current or Lower at 7-8 mA or Lower>

Hazard level 1 represents that values of bioelectric currents are in a range of perception current or in a range of pain tolerance current at 7-8 mA or lower, in which an operator can feel tingle when subjected to the range of electric shock, of which the operator may be warned.

Specifically, in the case where values of electric current sensed by the sensor 110 are in the first range in S330, the control unit 120 may output a warning sound of hazard level 1 through the speaker 131 and switch on an LED through the display unit 132 in S340, so that the operator wearing a wearable device 100 may be warned of a hazard situation.

<Hazard Level 2: Bioelectric Currents (Second Range) in a Range of Pain Tolerance Current to Let-go Current at 7-8 mA to 10-15 mA>

Hazard level 2 represents that values of bioelectric currents are in a range of pain tolerance current to let-go current at 7-8 mA to 10-15 mA, in which operators have different body resistance values, such that even when a level of electric current is identical, the electric current may affect individuals differently. In consideration of the above, hazard warning is given to an operator and nearby coworkers in hazard level 2, and the operation of hazard level 2 may be stopped in response to input of an operator's warning cancel instruction.

Specifically, in the case where values of electric current sensed by the sensor 110 are in the second range in S350, the control unit 120 may output a warning sound of hazard level 2 in S360. Further, the control unit 120 may transmit a warning message and a control signal to the distribution board 200 and wearable devices of other workers, which are linked to the wearable device of an operator, so as to warn of a hazard situation of the operator in S370. Here, the control signal may be a control signal to output a warning sound of hazard level 2 and to display a warning message.

Upon receiving a warning sound cancel instruction from the operator, the control unit 120 transmits, through the communication unit 140, the warning sound cancel instruction to the distribution board 200 and the linked wearable devices 100A to 100D, and may stop the operation corresponding to hazard level 2 in S380.

<Hazard Level 3: Bioelectric Currents (Third Range) in a Range of Let-go Current at 10-15 mA or Higher>

Hazard level 3 represents that values of bioelectric currents are in a range of let-go current at 10-15 mA or higher, which may threaten the operator's life, such that it may be determined to cut off the distribution board immediately.

Specifically, in the case where values of electric current sensed by the sensor 110 are in the third range, the control unit 120 may output a warning sound of hazard level 3 in S390. Further, the control unit 120 may transmit a cut-off instruction to the distribution board 200 in S395.

Further, the control unit 120 may transmit a warning message, indicating a hazard situation and the cut-off of the distribution board, to the wearable devices of other workers that are linked to the wearable device of the operator in S400.

Operations of the distribution board 200, which receives a warning message and a control signal from the wearable device 100, will be described below. Referring to FIG. 2, the distribution board 200 includes a communication unit 210, a control unit 220, a warning unit 230, and a circuit breaker 240. The circuit breaker 240 may include a main breaker 241, a sub breaker 242, and an electric shock breaker 243.

The communication unit 210 may receive, through the communication network of FIG. 1, a warning message and a control signal from the wearable devices 100A to 100D.

The control unit 220 may control the warning unit 230 to output the warning message, received from the wearable devices 100A to 100D, and a warning sound.

The warning unit 230 may provide warning sounds and warning messages corresponding to hazard levels (hazard levels 2 and 3), and may operate in the same manner as the warning unit 130 of the wearable device 100.

Further, upon receiving a warning message and a control signal (instruction to cut off the distribution board) corresponding to hazard level 3, the control unit 220 controls the electric shock breaker 243 to cut off the main breaker 241 or all the sub breakers, except for a sub breaker that supplies power to the warning unit 230, thereby removing causes of electric shock.

The operation, performed in response to receiving the warning message and the control signal of the wearable device 100 of other worker that is linked to the wearable device 100 of the operator in a hazard situation, will be described with reference to FIG. 4 below.

Figure 4:
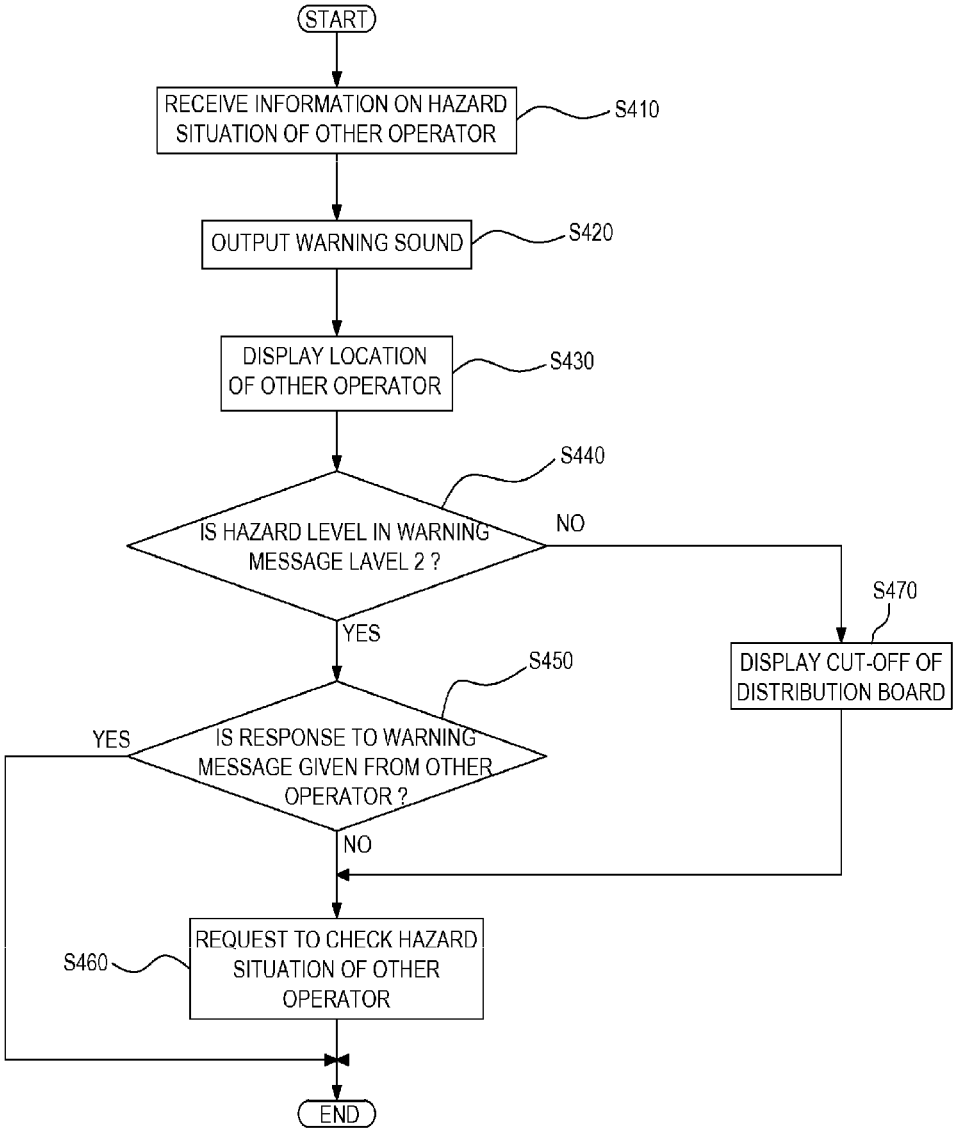
FIG. 4 is a flowchart illustrating a method of warning other wearable devices (nearby coworkers) of an electric shock according to another exemplary embodiment of the present invention.

FIG. 4 is a flowchart illustrating a method of warning other wearable devices (nearby coworkers of an operator) of an electric shock according to another exemplary embodiment of the present invention. Referring to FIG. 4, upon receiving a warning message and a control signal regarding a hazard situation of other operator in S410, a warning sound corresponding to the hazard situation is output to warn that the other operator is in the hazard situation in S420, and the location of the other operator in the hazard situation may be displayed in S430. Here, the received warning message is a message that notifies the hazard situation, and may include the location of the other operator in the hazard situation. The control signal includes a signal that indicates the level of hazard, a warning instruction control signal, and the like.

In the case where the hazard level in the received warning message is level 2 (Yes in S440), it is determined whether a response to the warning message is given from the other operator within a predetermined period of time in S450. If a response is given, it may be determined that the other operator escapes from the hazard situation. By contrast, if a response is not given, a request message for checking the hazard situation of the other operator may be provided.

In the case where the hazard level in the received warning message is level 3 (No in S440), the cut-off of the distribution board is displayed in S470, and a request message for checking the hazard situation of the other operator may be provided.

Accordingly, in the case where a hazard situation occurs to an operator, the wearable device worn by the operator may provide information on the hazard situation to nearby wearable devices linked to the wearable device of the operator and the distribution board, so that nearby coworkers may be warned of the hazard situation and may help the operator to escape therefrom.

While preferred embodiments of the present invention have been disclosed for illustrative purpose, the present invention is not limited hereto. Instead, those skilled in the art will appreciate that may variations, modification, and addition may be made without departing from the scope and spirit of the invention as defined by the following claims.

EXPLANATION OF REFERENCE NUMERALS

1000: Electric shock warning distribution board system

100 (100A to 100D): Wearable device

110: Sensor 120: Control unit 130: Warning unit 140: Communication unit

200: Distribution board

210: Communication unit 220: Control unit 230: Warning unit 240: Circuit breaker

The invention claimed is:

1. A wearable device for warning an electric shock, the wearable device comprising:

a sensor which comes into contact with a body of an operator who operates a distribution board, and is configured to sense bioelectric currents of the operator;

a control unit configured to monitor the sensed bioelectric currents, classify degrees of hazard of the operator according to values of the monitored bioelectric currents, and to warn of the operator of levels of electric shock hazard situations according to the classified degrees of hazard; and a warning unit configured to visually and audibly display the levels of electric shock hazard situations, wherein when the sensed bioelectric currents are in 8 mA to 15 mA, the control unit transmits a first warning message, notifying an electric shock hazard situation, to adjacent wearable devices linked to the wearable device of the operator and the distribution board, so as to notify a hazard situation of the operator.

2. The wearable device of claim 1, wherein the warning unit comprises:

an LED or a display unit configured to display a message; and a speaker configured to output a warning sound, wherein when the sensed bioelectric currents are 7 mA or lower, the control unit controls the display unit to display a second warning message or to switch on and off the LED, and to output the warning sound through the speaker.

3. The wearable device of claim 1, wherein when the sensed bioelectric currents are 15 mA or higher, the control unit transmits a cut-off instruction to the distribution board to cut off the distribution board, and notifies the cut-off of the distribution board to the adjacent wearable devices linked to the wearable device of the operator.

4. An electric shock warning distribution system comprising:

a distribution board; and a wearable device configured to monitor bioelectric currents flowing through a body of an operator that operates the distribution board, classify degrees of hazard of the operator according to values of the monitored bioelectric currents, and to warn the operator of levels of electric shock hazard situations according to the classified degrees of hazard, wherein the wearable device is worn by each operator, the wearable device of the operator transmits, to adjacent wearable devices, a first warning message that warns other operators of an electric shock hazard situation of the operator when the operator is in a hazard situation, and the distribution board receives information on an electric shock hazard situation of the operator from each wearable device to warn the electric shock hazard situation of the operator.

5. The electric shock warning distribution system of claim 4, wherein:

when the bioelectric currents are 7 mA or lower, the wearable device of the operator outputs a warning sound and a second warning message through the wearable device of the operator;

when the bioelectric currents are in 8 mA to 15 mA, the wearable device of the operator transmits the first warning message that notifies the electric shock hazard situation, to the adjacent wearable devices and the distribution board, so as to notify the hazard situation of the operator; and when the bioelectric currents are 15 mA or higher, the wearable device of the operator transmits a cut-off instruction to the distribution board to cut off the distribution board, and notifies the cut-off of the distribution board to the adjacent wearable devices.

* * * * *